US005540262A

United States Patent [19]

Bassi et al.

[11] Patent Number: 5,540,262

[45] Date of Patent: Jul. 30, 1996

[54] TACKLE ASSEMBLY FOR WEAVING LOOM

[75] Inventors: Dario Bassi, Chaponnay; Michaël Himmelstoff, Lyons, both of France

[73] Assignee: Staubli Lyon, Chassieu Cedex, France

[21] Appl. No.: 377,654

[22] Filed: Jan. 23, 1995

[30] Foreign Application Priority Data

Jan. 28, 1994 [FR] France ..... 94 01179

[51] Int. Cl.[6] ..... D03C 3/00

[52] U.S. Cl. ..... 139/65; 254/396

[58] Field of Search ..... 139/65; 254/396

[56] References Cited

U.S. PATENT DOCUMENTS 5,038,837 8/1991 Palau et al. ..... 139/65

5,139,052 8/1992 Derudder ..... 139/65

5,353,846 10/1994 Gheysen et al. ..... 139/65

FOREIGN PATENT DOCUMENTS 0433196 7/1994 France .

*Primary Examiner*—Andy Falik

*Attorney, Agent, or Firm*—Dowell & Dowell

[57] ABSTRACT

A four position tackle assembly for controlling the movement of at least one heddle in a weaving loom, including adjacent pulley blocks having first and second pulleys. A cord member is secured at one end relative to the weaving loom and successively extends therefrom over an idle pulley mounted to a first of the pulley blocks, a first guide pulley, the second pulley of the first pulley block, a second guide pulley, and the second pulley of the second pulley block to an end which is securable to at least one heddle.

1 Claim, 1 Drawing Sheet

A
B
a
2a
3a

TACKLE ASSEMBLY FOR WEAVING LOOM

BACKGROUND OF THE INVENTION

The present invention relates to a weave mechanism allowing warp yarns to be brought into four different positions via two vertically mobile griffe frames.

HISTORY OF THE RELATED

Devices are known, which bring the warp yarns into three different positions via a plurality of vertically mobile griffe frames. This weave mechanism comprises two adjacent shed-forming devices which each comprise two hooks vertically moveable under the effect of knives which move in opposition in a reciprocating movement. The hooks of each device are joined by a small cord passing around a pulley of a pulley block. Between the second pulley of the pulley block of each device is placed a pulley mounted idly on a shaft fixed with respect to the frame of the mechanism. A cord, having one end anchored in the frame, firstly surrounds the second pulley of the pulley block of the first shed-forming device, then extends about the idle pulley mounted on the fixed shaft and about the second pulley of the pulley block of the second device.

This weave mechanism therefore enables a snap located at a free end of the cord and to which at least one heddle is hooked, to be placed in three different positions.

Applicants' European Patent 433 196 also discloses shed-forming devices which ensure a large opening of its shed. These devices comprise an idle pulley of reduced diameter which is mounted in a pulley block known per se, while another guide pulley is provided, fixed on the frame of the mechanism. A cord is secured at one of its ends on the frame of the mechanism passes around the idle pulley, the guide pulley and, finally, the second pulley of the pulley block of the device, successively.

The shed-forming device, of which the free end of the cord carries a snap to which a heddle is attached, makes it possible either to double the height of opening of the shed by maintaining the stroke of the knives, or to reduce it by half by conserving the original shed height.

None of the heretofore described devices, however, enables a weave mechanism to obtain four positions of the warp yarns.

It is a more particular object of the present invention to overcome this drawback.

SUMMARY OF THE INVENTION

The tackle assembly for a weaving loom of the present invention comprises a pair of tackle or pulley blocks having first and second pulleys. An idle pulley is rotatably mounted relative to a first of the pulley blocks. Two guide pulleys are also provided which are mounted relative to the frame of the weaving loom. A cord member for controlling the movement of at least one heddle is secured at a first end relative to the frame of the loom and successively extends therefrom over the idle pulley, a first of the guide pulleys, the second pulley of the first pulley block, the other of the guide pulleys, the second pulley of the other pulley block to an opposite end. The opposite end of the cord member is provided to be connected to at least one heddle by way of a snap mechanism.

BRIEF DESCRIPTION OF THE DRAWINGS

The invention will be more readily understood on reading the following description with reference to the accompanying drawings, in which.

DESCRIPTION OF PREFERRED EMBODIMENT

Figures 1, 2, 3, 4:
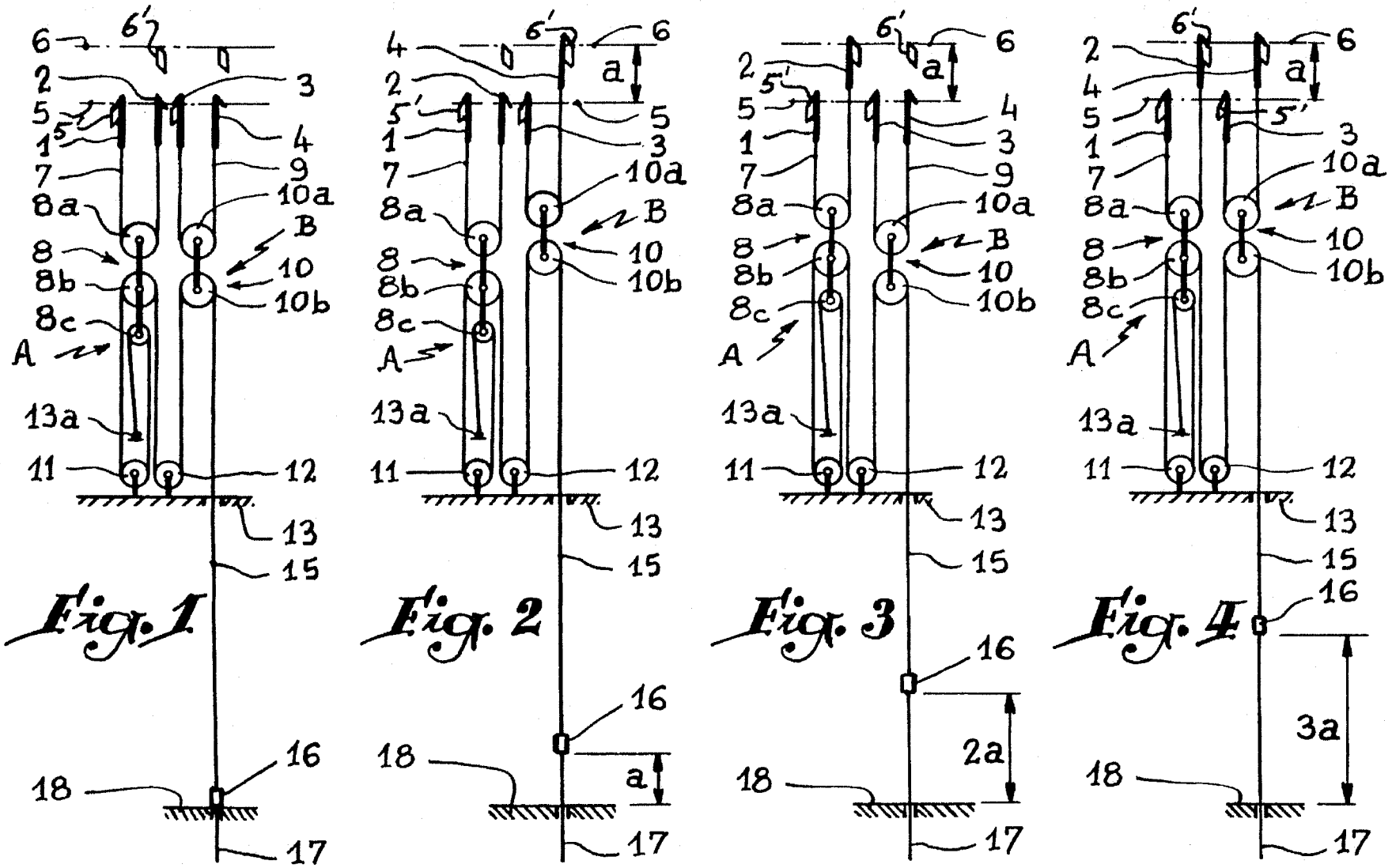
FIGS. 1 to 4 schematically illustrate the assembly of the elements of a weave mechanism incorporating hooks, according to the invention, with the snap of the harness in low, mean, intermediate and high position, respectively.

Referring now to the drawings, FIGS. 1 to 4 show a weave mechanism adapted to produce four positions of the warp yarns of a weaving loom which comprises, for each harness, two adjacent shed-forming devices A and B which are respectively provided with two hooks 1, 2 and 3, 4 adapted to cooperate with two griffe frames 5 and 6 each carrying knives known per se and generally illustrated at 5' and 6'.

Hooks 1 and 2 of the first device A are joined by a cord 7 passing around the first pulley 8*a* of a pulley block 8. Likewise, hooks 3, 4 of the second device B are joined by a cord 9 passing around the first pulley 10*a* of a pulley block 10.

Hooks 1, 2 and 3, 4 move vertically via the knives disposed on the griffe frame 5 and 6 and animated by a reciprocating movement.

The pulley block 8 of device A comprises a third pulley 8*c* mounted idly and of diameter smaller than that of pulleys 8*a* and 8*b*.

Between devices A and B are placed two guide pulleys 11 and 12 each rotating freely about a shaft secured to the frame 13 of the mechanism. A cord member 15 has a first end anchored at a fixed point 13*a* of the frame 13. The cord successively passes around the idle pulley 8*c* of the pulley block 8, the guide pulley 11 secured to the frame 13, the second pulley 8*b* of the pulley block 8 of the first device A, the second guide pulley 12 and, finally, the second pulley 10*b* of the pulley block 10 of the second device B. The other end of the cord 15 carries a snap 16 to which at least one heddle 17 is fixed relative to a perforated board 18.

A double block and tackle is thus produced, enabling four desired positions of the snap 16 to be obtained, namely a low position corresponding to the lower position of the warp yarns (FIG. 1), a second, mean position shown in FIG. 2, a third, intermediate position (FIG. 3) and a fourth, high or upper position (FIG. 4).

When the warp yarns are to be in low position (FIG. 1), hooks 1, 2 and 3, 4 of devices A and B are not driven by the knives of the griffe frames 5 and 6 when these latter make a reciprocating movement. The snap 16 thus remains in low position adjacent the perforated board 18 and all thee hooks 1, 2 and 3, 4 of devices A and B are in low position.

It will be noted that the griffe frames 5 and 6 make a reciprocating movement equal to a distance referenced *a*.

The second position of snap 16 is attained when hooks 3 and 4 of device B are raised alternately and respectively by the griffe frames 5 and 6, while hooks and 2 of the first device A remain in low position, i.e. they are not driven by the knives of the frames. As the first end of the cord 15, is joined to a fixed point 13*a* of frame 13, the cord is drawn by pulley 10*b* of the pulley block 10 of the second device B by a distance which allows the snap 16 to move over a distance a equivalent to that of the griffe frames 5 and 6 (FIG. 2).

The third position of snap 16 is attained when hooks 1 and 2 of the first device A are raised alternately by the knives of the griffe frames 5 and 6, while hooks 3 and 4 remain in low position, i.e. they are not driven by the frames. In this instance, the vertical displacement of the pulley block 8 successively drives cord 15 around the second pulley 8*b* of the pulley block 8 of the first device A, the idle pulley 8*c*, the two guide pulleys 11 and 2, and, finally, the second pulley 10*b* of the pulley block 10 of the second device B. Displacement of cord 15 created by the reciprocating movement of hooks 1, 2 of device A allow the snap 16 to move over a distance 2*a* with respect to the perforated board 18 (FIG. 3).

Finally, the fourth position of snap 16 is attained when hooks 1, 3 and 2, 4 are raised alternately and respectively by the knives of the griffe frames 5 and 6 so that each pulley block 8 and 10 of devices A and B makes a vertical reciprocating movement. It will be noted that cord 15 is driven successively around the different pulleys of the mechanism so that snap 16 moves over a distance 3*a* with respect to the perforated board 18.

In this way, a weave mechanism is obtained, which makes it possible to attain four positions of the snap 16 with respect to the perforated board 18 for the same displacement *a* of the griffe frames 5 and 6; these four positions may be attained in freely programmed sequences (from a given position, any one of the other three positions may be directly attained). Devices A and B may, of course, be those described in Applicants' French Patent 2 587 045.

What is claimed is:

1. A tackle assembly for a weaving loom of the type including two adjacent shed-forming devices, each having two hooks vertically movable by knives of griffe frames which knives move in opposite reciprocating movement, the tackle assembly adapted to move warp yarns to four positions and comprising, first and second pulley blocks each having first and second pulleys, a pair of cords for connecting the hooks of the two adjacent shed-forming devices to the first pulleys of said first and second pulley blocks, respectively, an idle pulley rotatably mounted to the first pulley block, first and second guide pulleys adapted to be mounted to the weaving loom, a cord member having a first end adapted to be anchored relative to the weaving loom, said cord member successively extending around said idle pulley, said first guide pulley, said second pulley of said first pulley block, said second guide pulley and said second pulley of said second pulley block to an opposite end of said cord member which is securable to at least one heddle.

* * * * *